US008403705B2

(12) United States Patent
Liu et al.

(10) Patent No.: US 8,403,705 B2
(45) Date of Patent: Mar. 26, 2013

(54) ELECTRICAL CONNECTOR WITH A PRINTED CIRCUIT BOARD

(75) Inventors: Su-Feng Liu, Kunshan (CN); Chin-Te Lai, New Taipei (TW); Bin Xu, Kunshan (CN)

(73) Assignee: Hon Hai Precision Inc. Co., Ltd., New Taipei (TW)

( * ) Notice: Subject to any disclaimer, the term of this patent is extended or adjusted under 35 U.S.C. 154(b) by 0 days.

(21) Appl. No.: 13/279,246

(22) Filed: Oct. 22, 2011

(65) Prior Publication Data

US 2012/0100759 A1 Apr. 26, 2012

(51) Int. Cl.
*H01R 13/648* (2006.01)

(52) U.S. Cl. ..... 439/607.4; 439/607.58

(58) Field of Classification Search ..... 439/607.4, 439/607.35, 607.53, 680, 76.1, 79, 540.1, 439/541.5, 620.13, 620.12, 620.29, 607.13, 439/607.14, 607.36, 607.38, 607.43, 607.51, 439/607.57

See application file for complete search history.

(56) References Cited

U.S. PATENT DOCUMENTS 5,066,236 A * 11/1991 Broeksteeg ..... 439/79
6,572,409 B2 * 6/2003 Nitta et al. ..... 439/607.05

FOREIGN PATENT DOCUMENTS

TW M361805 7/2009

* cited by examiner

*Primary Examiner* — Edwin A. Leon
*Assistant Examiner* — Harshad Patel
(74) *Attorney, Agent, or Firm* — Wei Te Chung; Ming Chieh Chang

(57) ABSTRACT

An electrical connector comprises: a housing defining a plurality of walls and a receiving room surrounded by the walls, a metal shell enclosing the housing, a PCB located under the metal shell, a terminal module received in the housing and defining a plurality of terminals passing through the PCB and extending out of the metal shell and an insulative outer cover having a receiving cavity enclosing the metal shell, a block wall limiting the PCB moving forwardly and at least one convex limiting the metal shell moving rearwardly.

17 Claims, 7 Drawing Sheets

ELECTRICAL CONNECTOR WITH A PRINTED CIRCUIT BOARD

FIELD OF THE INVENTION

The present invention relates to an electrical connector, and more particularly to an electrical connector with a printed circuit board.

DESCRIPTION OF PRIOR ART

Taiwan Pat. No. M361805 issued on Jul. 21, 2009, disclosed an electrical connector comprising a base, a front cover, an upper cover, a board, and a metal shell enclosing the base, the front cover and the upper cover. A gap is recessed upwardly from a lower rear outer surface to an inner surface of the metal shell. The base defines a plurality of conductive legs located on a rear end thereof. The conductive legs are extended out of the base. The PCB has a number of inserting holes passed through the upper and lower surface thereof for being received and electrically connected to the conductive legs. The PCB is located in the gap of the metal shell and exposed out of the metal shell. The PCB is retained by the conductive legs soldered on the PCB only. There are not other structures or devices protecting the PCB. When moving or shaking the electrical connector, we may make the soldering spot off and destroy the electrical connector.

Maybe molding a cover on outer surfaces of the metal shell can enclose the PCB and protect the electrical connector. However, the inner structures of the electrical connector are complex, the plastic in molding may be nm into a mating cavity of the electrical connector.

As discussed above, an improved electrical connector overcoming the shortages of existing technology is needed.

SUMMARY OF THE INVENTION

Accordingly, an object of the present invention is to provide an electrical connector with a protection structure for protecting a PCB assembled in the electrical connector.

In order to achieve the above-mentioned objects, an electrical connector comprises: a housing defining a plurality of walls and a receiving room surrounded by the walls, a metal shell enclosing the housing, a PCB located under the metal shell, a terminal module received in the housing and defining a plurality of terminals passing through the PCB and extending out of the metal shell and an insulative outer cover having a receiving cavity enclosing the metal shell, a block wall limiting the PCB moving forwardly and at least one convex limiting the metal shell moving rearwardly.

Other objects, features and advantages of the invention will be apparent from the following detailed description taken in connection with the accompanying drawings.

DETAILED DESCRIPTION OF PREFERRED EMBODIMENTS

Figure 1:
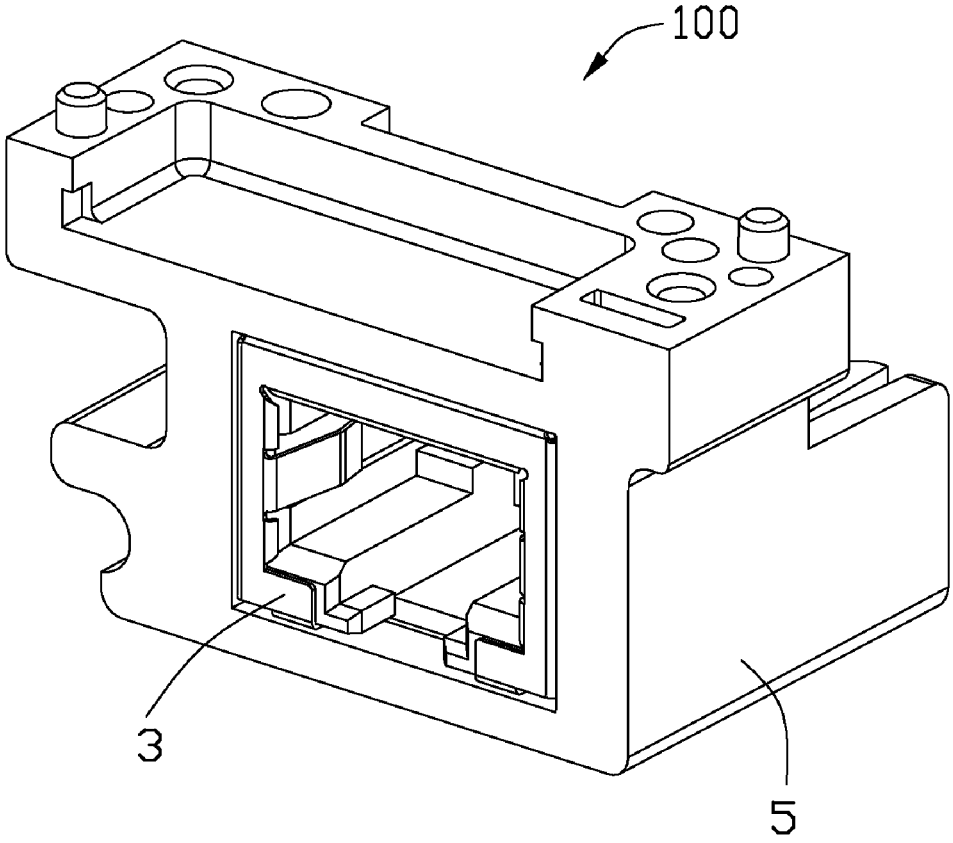
FIG. 1 is a perspective view of an electrical connector in accordance with the present invention.

Reference will now be made to the drawing figures to describe the present invention in detail.

Figure 2:
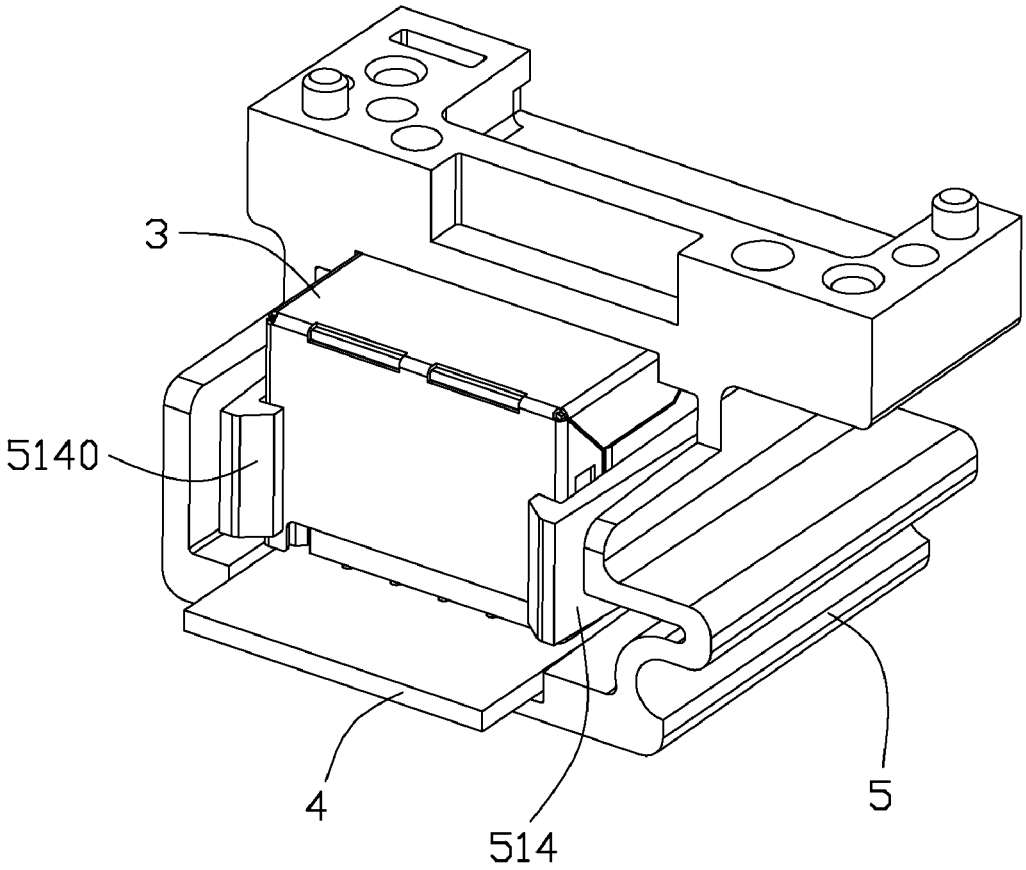
FIG. 2 is a view similar to FIG. 1, from another aspect.
Figure 3:
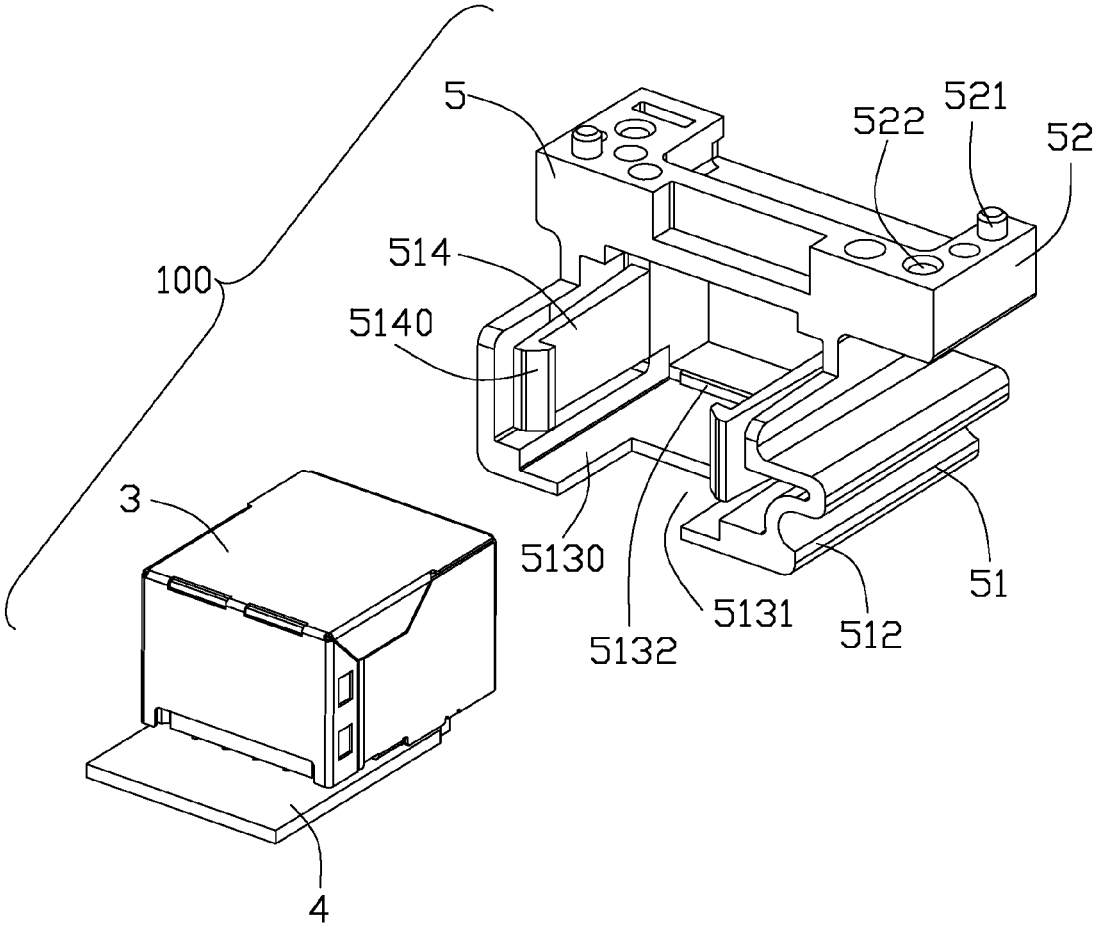
FIG. 3 is a partially assembled view of the electrical connector shown in FIG. 1.
Figure 4:
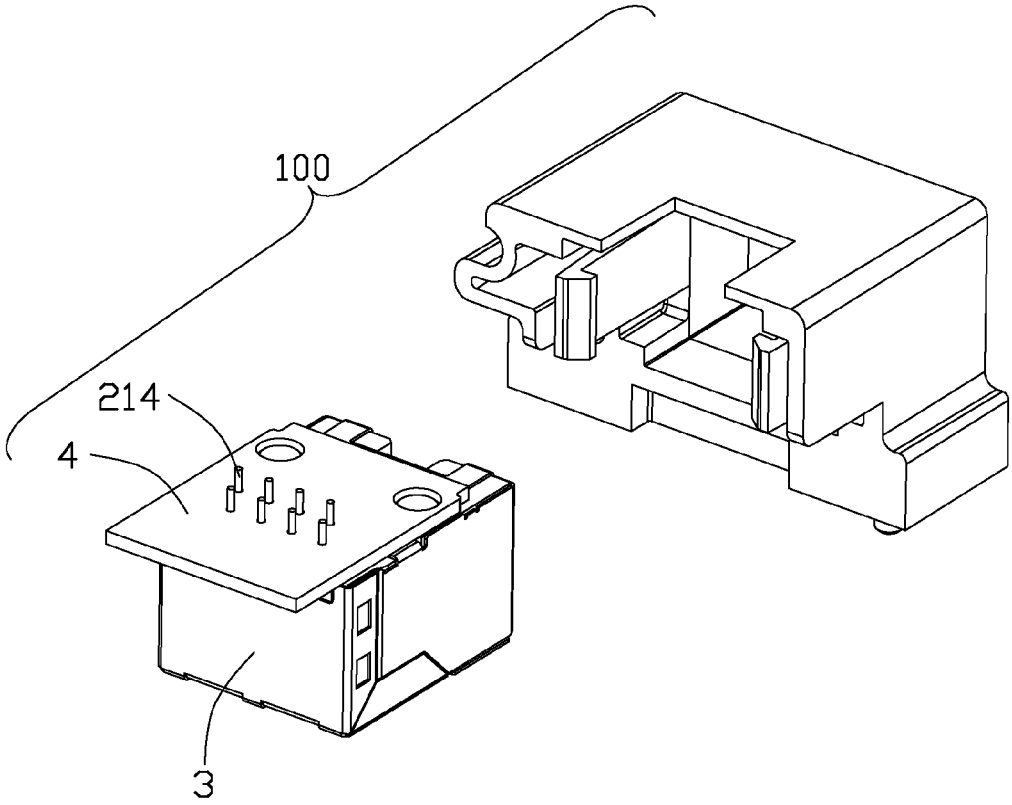
FIG. 4 is a view similar to FIG. 3, from another aspect.
Figure 5:
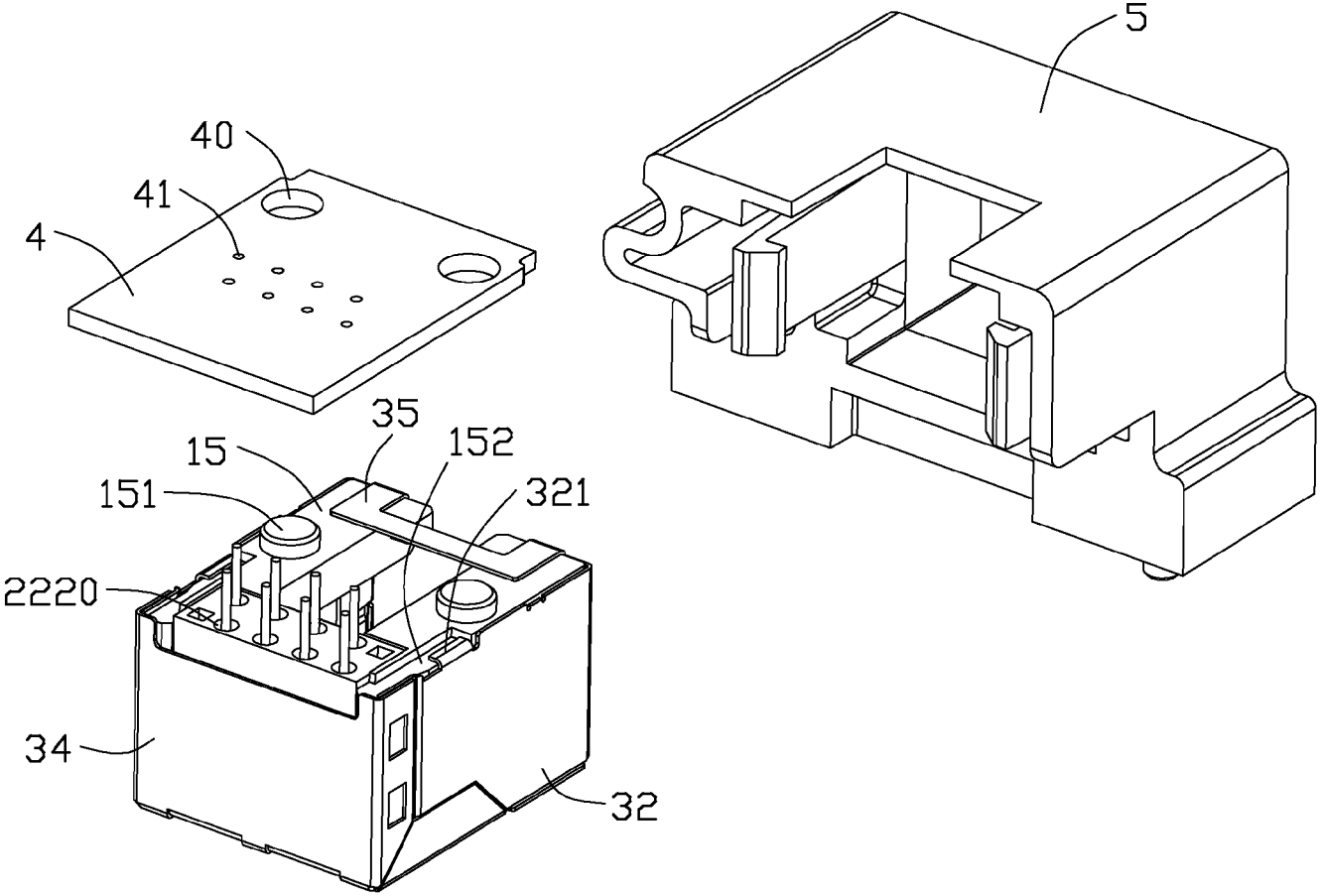
FIG. 5 is other partially assembled view of the electrical connector.
Figure 6:
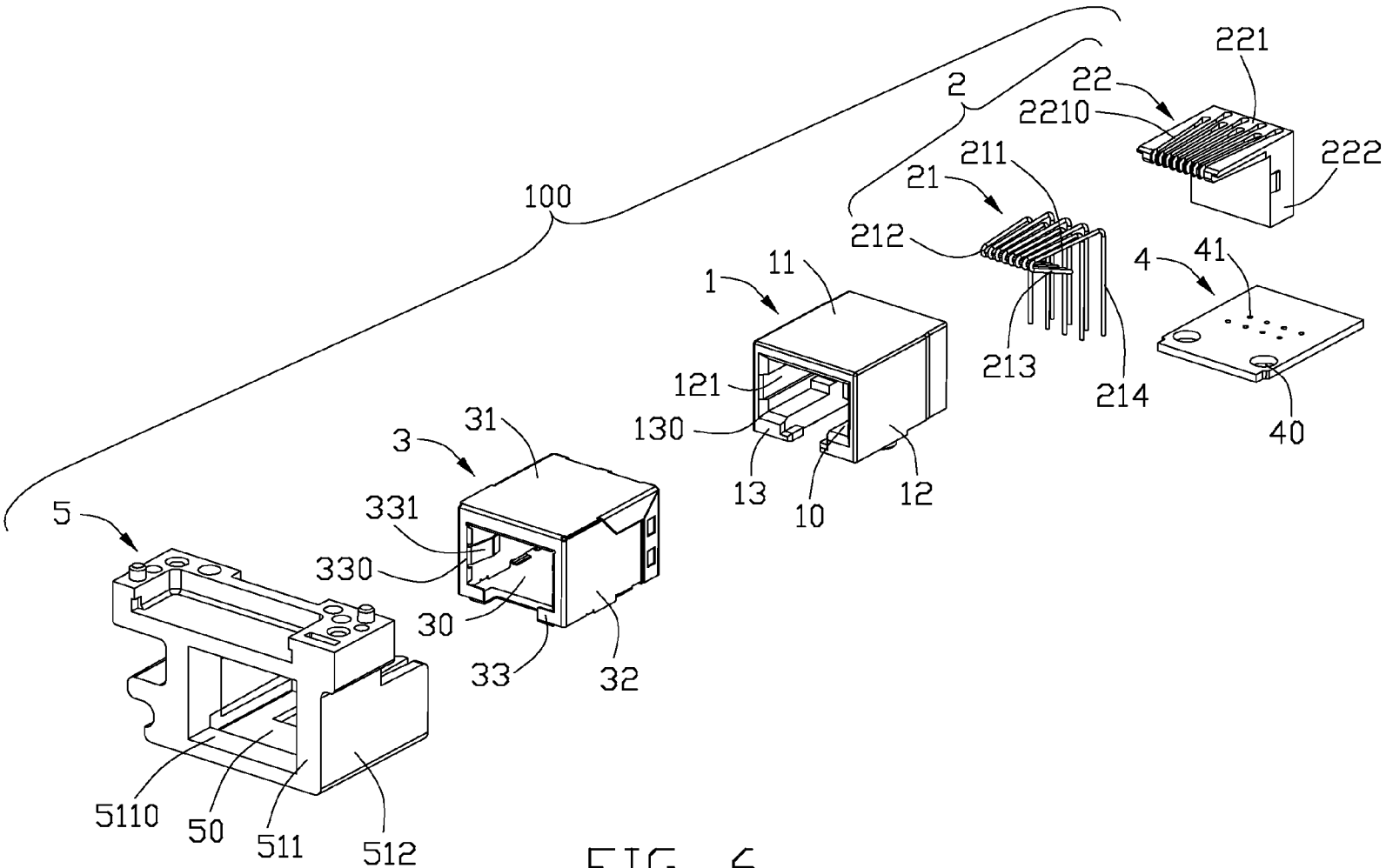
FIG. 6 is an exploded, perspective view of the electrical connector shown in FIG. 1.
Figure 7:
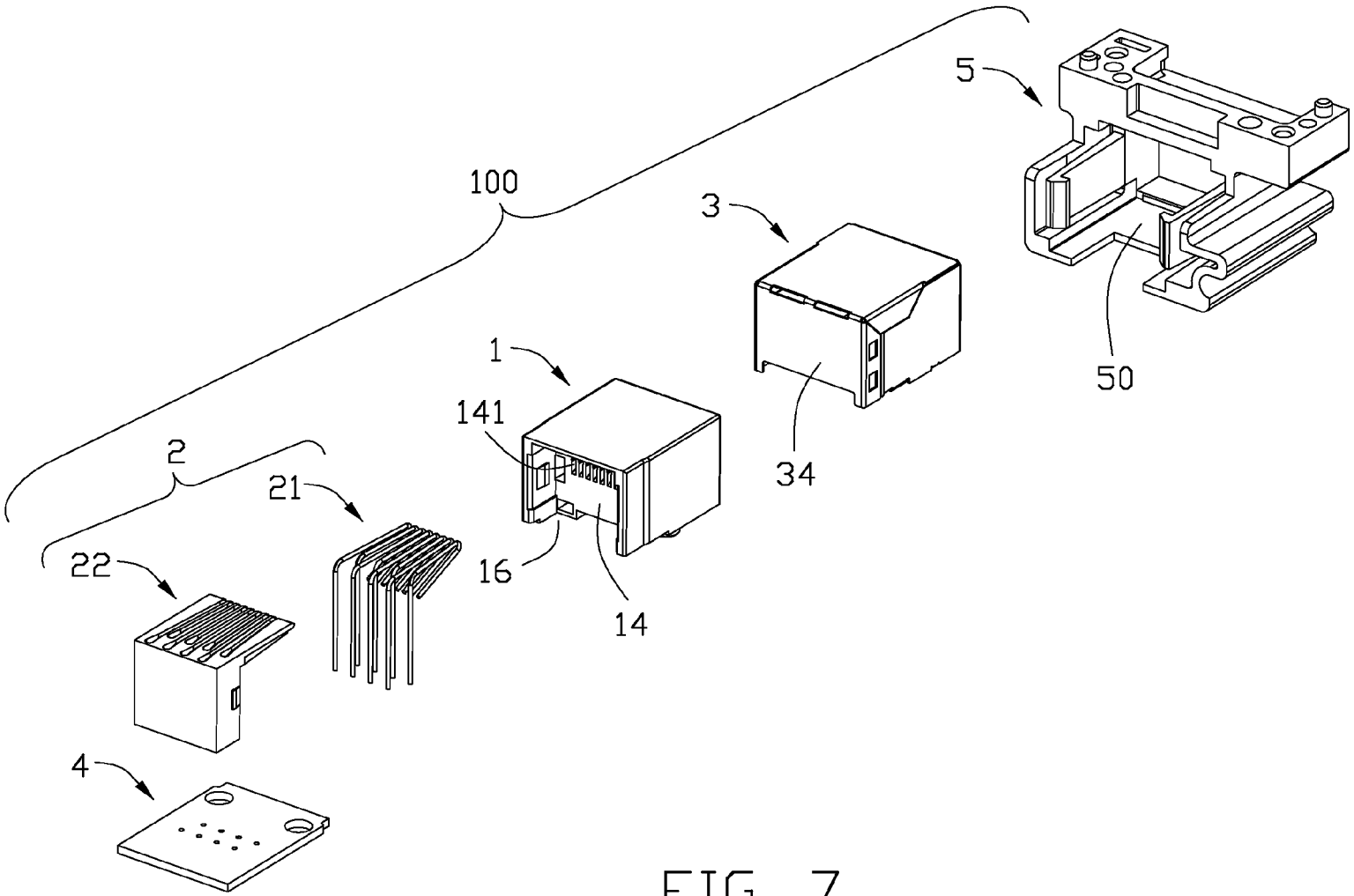
FIG. 7 is a view similar to FIG. 6, from another aspect.

Referring to FIGS. 1 to 7, an electrical connector 100 in accordance with the present invention comprises a housing 1, a terminal module 2 installed in the housing 1, a metal shell 3 enclosing the housing 1, a printed circuit board (PCB) 4 connected to the terminal module 2 and an insulative outer cover 5 enclosing the metal shell 3.

The housing 1 comprises an upper wall 11, two lateral walls 12, a front wall 13, an inner wall 14 located in the internal thereof and a lower wall 15. A receiving room 10 is formed by said walls surrounded and located in a front end of the housing 1. A receiving groove 16 is recessed forwardly from a rear surface of the housing 1. The receiving room 10 and the receiving groove 16 are apart from the inner wall 14. The receiving room 10 and the receiving groove 16 are through the lower wall 15. The front wall 13 defines a cutout 130 communication with the receiving room 10. The inner wall 14 defines a plurality of terminal passageways 141 extending along a mating direction of the electrical connector 1 and communicated the receiving room 10 with the receiving groove 16. The lower wall 15 defines a pair of protrusions 151 extending downwardly from two sides thereof and at least one though 152 at the edge thereof. A notch 121 is defined respectively in the inner surface of each lateral wall 12.

The terminal module 2 comprises a plurality of terminals 21 and a main portion 22 molding on the terminals 22. The main portion 22 comprises a flat portion 221 and a vertical portion 222 perpendicular to the flat portion 221. Each terminal 21 includes a first retaining portion 211 retained in the flat portion 221, a connecting portion 212 bending from a front end of the first retaining portion 211 to a rear end thereof, a mating portion 213 extending slantly rearwardly from the connecting portion 212 and a second retaining portion 214 extending downwardly from the rear end of the first retaining portion 211 and perpendicular to the first retaining portion 221. The flat portion 221 of the main portion 22 defines a plurality of first retaining slots 2210 for receiving the first retaining portion 221. The vertical portion 222 defines a plurality of second retaining grooves 2220 for receiving the second retaining portion 224. The first retaining slots 2210 are communicated with the second retaining portion 2220.

The metal shell 3 comprises an upper portion 31 enclosing the upper wall 11 of the housing 1, a pair of lateral portions 32 enclosing the lateral wall 12 of the housing 1, a front portion 33 enclosing the front wall 13 of the housing 1 and a rear portion 34 enclosing the receiving groove 16 located on the rear surface of the housing 1. At least one retaining pin 321 is defined at the lower edge of the lateral portion 32 and bended inwardly for receiving the through 152 of the lower wall 15. A accommodating room 30 is surrounded by the upper portion 31, the lateral portions 32, the front portion 33 and the rear portion 34. The front portion 33 defines an opening 330 corresponding to the cutout 130 of the housing 1 and a pair of elastic members 331 extending rearwardly from two edges of the opening 330 into the accommodating room 30. The end of the elastic member 331 is bended outwardly. The mid of the elastic member 331 is raised to the middle of the accommodating room 30. A U-shaped supporting portion 35 extends rearwardly from the lower edge of the front wall 33 for supporting the housing 1.

The PCB 4 comprise a pair of receiving holes 40 receiving the protrusions 151 of the housing 1 and a number of through holes 41 through the upper and lower surface thereof. The through holes 41 are arranged in two rows.

The insulative outer cover 5 comprises a basic portion 51 and a fixing portion 52 located on the basic portion 51. A receiving cavity 50 is defined between the basic portion 51 and the fixing portion 52 for receiving the metal shell 3 and the housing 1. The basic portion 51 comprises a front wall 511, a pair of lateral walls 512 and a lower wall 513. A pair of flexible fixing arms 514 are extended respectively rearwardly from the receiving cavity 50. Each fixing arm 514 defines a convex 5140 raising inwardly form the rear end thereof. The front wall 511 defines a window 5110 corresponded to the cutout 130 and communicated with the receiving cavity 50. The lower wall 513 of the basic portion 51 defines an accommodating cavity 5130 behind the receiving cavity 50 and a rectangle gap 5131 run through a lower surface of the accommodating cavity 5130. A block wall 5132 is defined between the receiving cavity 50 and the accommodating cavity 5130. The fixing portion 52 defines a pair of columns 521 on an upper surface thereof and a number of holes 522 to make the electrical connector 100 assembled on a board of an electrical device.

In assembly, the main portion 22 is molded on the terminals 21. The rear end of the second retaining portion 214 extends out of the second retaining grooves 2220. The second retaining portions 214 of all of the terminals 22 are arranged in two rows. The main portion 22 is installed in the housing 1 along a rear-to-front direction, the vertical portion 222 is received in the receiving groove 16 of the housing 1 and the flat portion 221 located in the receiving room 10. The housing 1 is received in the metal shell 3. The elastic members 331 are received respectively in the notches 121 of the housing 1. The PCB 4 is assembled on the lower surface of the lower wall 15. The second retaining portion 214 is through the through holes 41 and the protrusions 151 are received in the receiving holes 40. A part of the PCB 4 is beyond to the rear portion 34. The metal shell is received in the receiving cavity 50 and the accommodating cavity 5130. The PCB 4 is located on an inner lower surface of the accommodating cavity 5130. The rear end of the second retaining portions 214 are exposed out of the rectangle gap 5131. The front surface of the metal shell 3 is attached to the window 5110. The front end of the PCB 4 is attached to the block wall 5132 for limiting the PCB 4 moving forwardly. The metal shell 3 is located between the two fixing arms 514. The convexes 5140 are attached to the rear portion 34 of the metal shell 3 for limiting the metal shell 3 moving rearwardly. The fixing arms 514 are attached to two lateral sides of the metal shell 3.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

a housing defining a plurality of walls and a receiving room surrounded by the walls;

a metal shell enclosing the housing;

a PCB located under the metal shell;

a terminal module received in the receiving room and defining a plurality of terminals passing through the PCB and extending out of the metal shell; and an insulative outer cover having a receiving cavity enclosing the metal shell, a block wall limiting the PCB moving forwardly and at least one convex limiting the metal shell moving rearwardly;

wherein the insulative outer cover defines a pair of flexible fixing arms located on two sides of the metal shell; the convex is located on the rear end of the fixing arm and raised inwardly, and wherein the convex is attached to the rear surface of the metal shell.

2. The electrical connector as recited in claim 1, wherein the insulative outer cover further comprises a basic and a fixing portion forming together the receiving cavity.

3. The electrical connector as recited in claim 2, wherein the block wall located on the rear end of the receiving cavity.

4. The electrical connector as recited in claim 3, wherein an accommodating cavity is formed on the rear of the block wall.

5. The electrical connector as recited in claim 4, wherein the PCB is located in the accommodating cavity and attached to the rear surface of the blocking wall.

6. The electrical connector as recited in claim 5, wherein the accommodating cavity has a gap run through a lower surface of the accommodating cavity and passed through the terminal.

7. The electrical connector as recited in claim 1, wherein the PCB has a pair of receiving holes, and the housing defines a pair of protrusions located a lower wall thereof and received respectively in the receiving holes of the PCB.

8. An electrical connector, comprising:

a housing defining a receiving room;

a plurality of terminals received in the receiving room;

a metal shell enclosing the housing;

a PCB located under the metal shell and retained under the housing; and an inslulative outer cover having a receiving cavity enclosing the metal shell and the PCB, a pair of flexible fixing arms extending rearwardly from the receiving cavity and a pair of convexes located respectively on the rear end of the fixing arms; wherein the convexes are attached to a rear surface of the metal shell, and the flexible fixing arms are attached to two lateral sides of the metal shell.

9. The electrical connector as recited in claim 8, wherein an accommodating cavity is located behind the receiving cavity and receiving the PCB.

10. The electrical connector as recited in claim 9, wherein a block wall is formed between the receiving cavity and the accommodating cavity, and the PCB is attached to a rear surface of the block wall.

11. The electrical connector as recited in claim 10, wherein the terminals are passed through the PCB and extended out of the insulative outer cover.

12. An electrical connector assembly for use with a plug, comprising:

an insulative outer cover defining a horizontal receiving space forwardly communicating with an exterior via an opening formed in a front face thereof, and said outer cover further equipped with a latch thereof;

a modular jack forwardly assembled into the receiving space and locked by the latch for not rearward moving;

the modular jack including:

an insulative housing defining a contour with a front section snugly exposed in the opening, and a plug receiving cavity formed in the housing and located behind the opening;

a plurality of terminals disposed in the housing with contacting sections exposed in the plug receiving cavity and tail sections exposed outside of the housing; and a printed circuit board to which the tail sections are secured; wherein the outer cover defines a slot adjacent to the receiving space to protectively receive the printed circuit board therein, said slot being hidden behind the front face of the outer cover.

13. The electrical connector assembly as claimed in claim 12, wherein the front section of the housing is essentially being coplanar with the front face of the outer cover.

14. The electrical connector assembly as claimed in claim 12, wherein said outer cover is equipped with a mounting device, for mounting to an exterior unit, on an exterior face which is perpendicular to the front face of the outer cover under condition that the housing is essentially located between the printed circuit board and the mounting device in a vertical direction.

15. The electrical connector assembly as claimed in claim 14, wherein the outer cover defines a notch in another exterior face opposite to said exterior face to expose the printed circuit board in the vertical direction.

16. The electrical connector assembly as claimed in claim 12, wherein the front section of the housing defines a narrowed locking region for locking a deflectable latch of the plug under condition that the printed circuit board is intimately located behind the narrowed locking region.

17. The electrical connector assembly as claimed in claim 12, wherein said latch is resilient for deflection during assembling or disassembling the modular jack with regard to the outer cover.

* * * * *